United States Patent [19]

Hashimoto et al.

[11] 4,150,070

[45] Apr. 17, 1979

[54] PISTON TYPE THROTTLE VALVE CARBURETOR

[75] Inventors: Shogo Hashimoto; Yoshimatsu Hashiba, both of Kanagawa, Japan

[73] Assignee: Mikuni Kogyo Kabushiki Kaisha, Tokyo, Japan

[21] Appl. No.: 869,360

[22] Filed: Jan. 13, 1978

[51] Int. Cl.[2] ..... F02M 9/06

[52] U.S. Cl. ..... 261/41 B; 261/44 B; 261/67

[58] Field of Search ..... 261/41 B, 44 B, 44 C, 261/67

[56] References Cited

U.S. PATENT DOCUMENTS

| | | | |
|---|---|---|---|
| 1,072,565 | 9/1913 | Brautigam | 261/44 B |
| 1,414,935 | 5/1922 | Cox et al. | 261/44 B |
| 1,444,222 | 2/1923 | Trego | 261/44 B |
| 1,604,279 | 10/1926 | Guy | 261/44 B |
| 2,756,033 | 7/1956 | Smith et al. | 261/44 B |

FOREIGN PATENT DOCUMENTS

| | | | |
|---|---|---|---|
| 734003 | 4/1943 | Fed. Rep. of Germany | 261/44 B |
| 231118 | 2/1944 | Switzerland | 261/44 C |
| 11811 of | 1915 | United Kingdom | 261/44 B |
| 16755 of | 1915 | United Kingdom | 261/44 B |
| 192934 | 2/1923 | United Kingdom | 261/44 B |
| 165033 | 7/1961 | U.S.S.R. | 261/67 |

*Primary Examiner*—Tim R. Miles

*Attorney, Agent, or Firm*—Ladas, Parry, Von Gehr, Goldsmith & Deschamps

[57] ABSTRACT

A piston type throttle valve carburetor which is provided with a pilot fuel feed system and more than one main fuel feed systems is disclosed. This carburetor smoothly responds to from light load to full load operation of the engine and can be manufactured without great working accuracy required.

4 Claims, 7 Drawing Figures

PISTON TYPE THROTTLE VALVE CARBURETOR

BACKGROUND OF THE INVENTION

This invention relates to an improved piston type throttle valve carburetor with a large air inlet port used for high power internal combustion engines.

The piston type throttle valve carburetor is constructed such that a needle valve is fixed facing the throttle, whereby the fuel supply is increased by opening the throttle valve, that is, by increasing air intake, and the fuel supply for the full load operation is defined by the cross-sectional area of the main jet.

Therefore, in the piston type throttle valve carburetor for high power internal combustion engines, the clearance between the jet needle and the metering section of the needle jet must be kept extremely small when the throttle is opened only slightly, that is, when the engine is operated under light load. This means that extreme accuracy is required in machining and assembling of the jet needle, needle jet, throttle valve body supporting the needle jet as well as the carburetor body supporting the needle jet. Otherwise, it is impossible to maintain supply of the fuel-air mixture of the proper mixture ratio required for the light load operation. Further, the extremely small clearance between the jet needle and the metering section of the needle valve impairs the effect of the air bleeding and thus impairs the fuel-vaporizing performance of the carburetor.

This invention is intended to provide an improved piston type throttle valve carburetor for high power internal combustion engines, which is able to supply properly mixed fuel-air mixture in the light load operation without keeping the clearance between the jet needle and the needle jet extremely small, and thus fully utilizes the effect of the air bleeding, that is, a carburetor such as is able to supply properly mixed fuel-air mixture over the full range of operation and can be manufactured with the accuracy, in machining and assembling jet needle, needle jet, and other related parts, of the same level as that in manufacturing small size carburetors.

SUMMARY OF THE INVENTION

According to this invention, an improved piston type throttle valve carburetor which is provided with a plurality of main fuel feed systems each comprising a jet needle, a needle jet and a main jet, whereby the jet needles are secured to the piston throttle valve, said main fuel feed systems are so positioned that they can meet from light load operation to full load operation, the sizes of the main jets are properly selected so that a properly mixed fuel-air mixture can be supplied at each stage of the engine operation, and that the combined cross-sectional area of the main jets is such as can supply enough fuel to support the full load operation of the engine, is provided. The above-mentioned intention is answered by this carburetor.

BRIEF DESCRIPTION OF THE DRAWING

Now the invention is explained in detail with reference to the attached drawings.

DETAILED DESCRIPTION OF THE INVENTION

Figure 1:
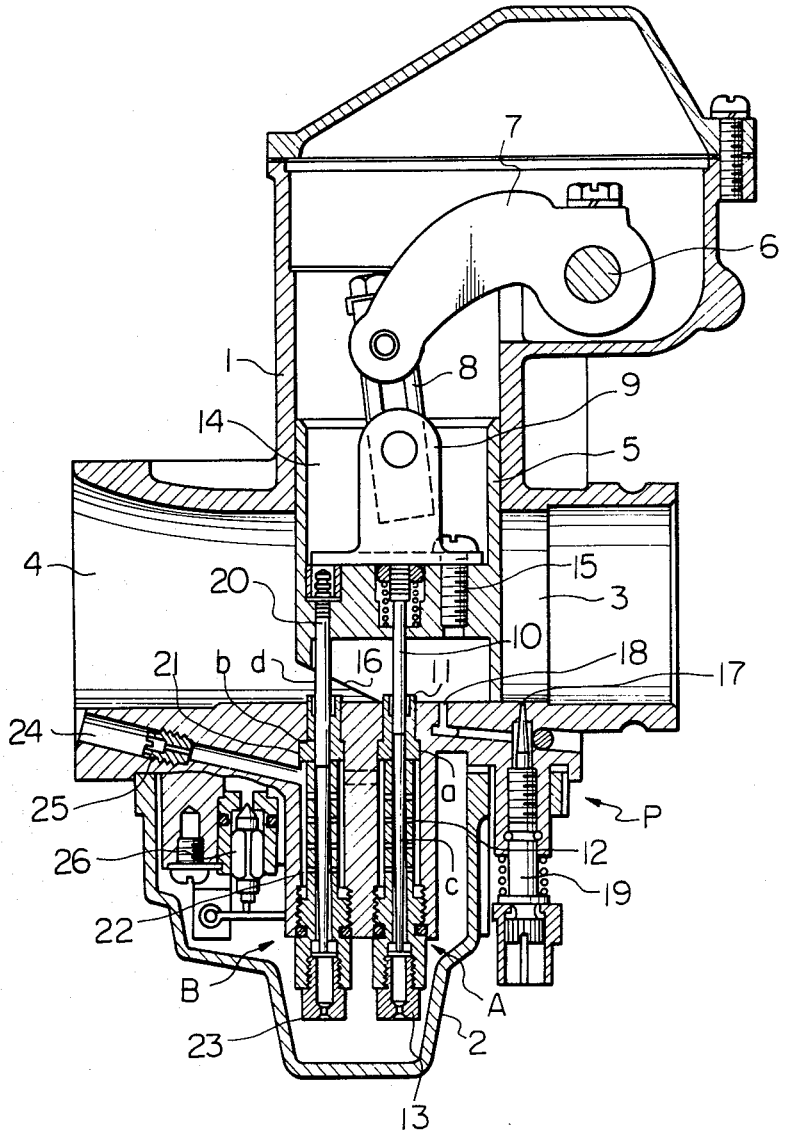
FIG. 1 is a cross-sectional view of a piston type throttle valve carburetor provided with two main fuel feed systems according to this invention.

The carburetor shown in FIG. 1 comprises a carburetor body 1, a float chamber 2, a mixing chamber 3, an air intake port 4, a piston throttle valve 5, a throttle valve operating shaft 6, a throttle valve operating arm 7 which is secured to said shaft 6, a throttle valve operating rod 8 which is pivotably connected to said arm, a connecting block 9 which is pivotably connected to said rod at the end thereof and is secured to the bottom of a recess 14 provided in the piston 5 by means of bolts 15, a first (primary) main fuel feed system A comprising a jet needle 10 secured to the center of the piston, a needle jet 11 and a main jet 13 provided in the float chamber part of the carburetor and a second (secondary) main fuel feed system B comprising a jet needle 20 secured to the air inlet port side of the piston, a needle jet 21 and a main jet 23 provided in the float part of the carburetor. In this embodiment, when the throttle valve operating shaft 6 is clockwise rotated, the throttle valve is opened. The piston has a cutaway 16 on the air inlet port side. The needle jets 11 and 21 respectively have a metering section a and b. The fuel feed systems A and B are respectively provided with perforations 12 and 22. A bleed air inlet 24 is provided in the float chamber part of the carburetor and air is introduced through a bleed air jet 25 and led to said perforations.

The carburetor is further provided with a pilot fuel feed system comprising an outlet orifice 17, a pilot bypass outlet 18, a fuel regulating valve 19. The float chamber is provided with a check valve 26 which regulates inflow of the fuel from a fuel tank or fuel pump (not shown) to the float chamber.

As seen in FIG. 1, in this embodiment, the primary fuel feed system is provided in the position corresponding to the center of the piston, and the secondary fuel feed system B is provided on the air inlet port side of the piston. The needle valve of the primary fuel feed system works as the fuel supplier in the range from light load operation to medium load operation, and the needle valve of the secondary fuel feed system works in the range from medium load operation to full load operation as an additional fuel supplier to the primary fuel feed system. That is to say, the primary fuel feed system is designed so that it can feed fuel in an amount which can support only up to the medium load operation. That is, the size of the main jet 13 is such that it allows the flow of the fuel in the amount to support the medium load operation of the engine. The secondary fuel feed system is designed so that when it is completely opened, it can supply fuel in the amount which can support the full load operation together with the primary fuel feed system which has already been completely opened. That is, the size of the main jet 23 is a little smaller than that of the main jet 13 since the main jet 23 may only feed fuel in the amount supplementary to the amount fed by the main jet 13. In order to effect this, the straight (cylindrical) part d of the jet needle 20 is elongated enough so that that part remains inserted in the metering section b until the throttle valve is opened to the middle position, that is, until the medium load operation of the engine is reached.

The carburetor constructed as explained above works as follows. In idling, fuel is supplied by the pilot fuel feed system only. When the engine comes to be operated with light load to medium load, that is, the piston valve is gradually raised to the middle position, then the jet needle 10 is also raised and the metering section a of the primary fuel feed system is wide opened. So, the fuel is fed into the mixing chamber in the amount defined by the main jet 13. At this time, however, the straight (cylindrical) part of the jet needle 21 still remains in the metering section b, and the secondary fuel feed system B per se is located at the position of the cutaway 16 of the piston valve, where the velocity of the inlet air is smaller. Therefore, no fuel is supplied into the mixing chamber through the secondary fuel feed system B. When the piston valve is further opened, the jet needle 21 is also raised and the metering section b of the secondary fuel system feed is now opened. Thus the fuel is supplied through the secondary fuel feed system, too, in addition to the primary fuel feed system. Thus at the full load operation, the fuel is supplied in the amount defined by the combined cross-sectional area of the main jets 13 and 23.

As learned from the above description, the size of the main jets 13 and 23 are smaller than that of the main jet of the carburetor provided with only one fuel feed system. Therefore, the clearance between the jet needle and the needle jet need not be extremely small. And thus the effect of the air bleed can be fully utilized.

Figure 2:
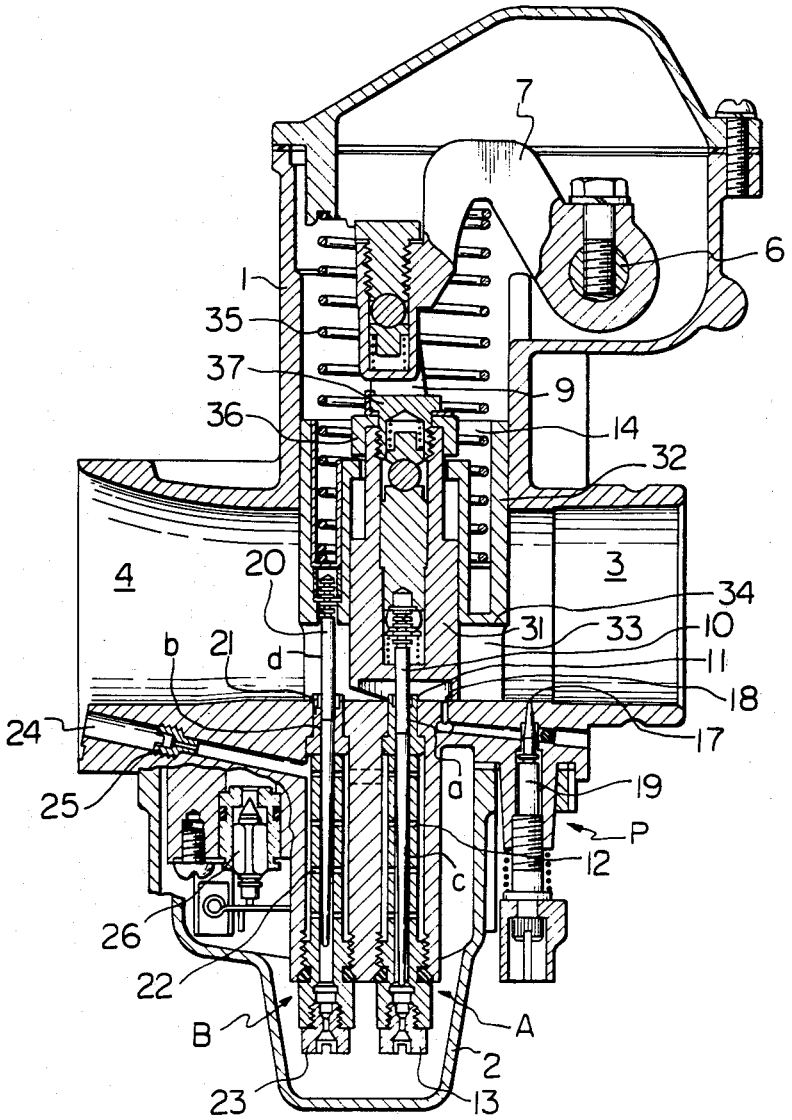
FIG. 2 is a cross-sectional view of a double piston type throttle valve carburetor provided with two main fuel feed systems according to this invention.

FIG. 2 represents another embodiment of this invention. This embodiment is substantially the same as that of FIG. 1 except that the piston type throttle valve comprises two pistons. The double piston throttle valve per se is known. In FIG. 2, the reference numbers represents parts the same as or equivalent to those in FIG. 1, except that 31 represents a smaller primary throttle valve, which is provided inside of a larger secondary throttle valve 32. A slot venturi 33 is provided at the lower part of the larger secondary throttle valve and is narrower than the diameter of the smaller primary throttle valve. The venturi 33 has a ceiling surface 34.

When the throttle valve operating shaft 6 is clockwise rotated, the smaller primary throttle valve 31 is first opened by the action of the throttle valve operating rod 8 and the connecting block 9. When the smaller primary throttle valve 31 is raised until its bottom is on the same level as the ceiling surface 34 of the venturi 33, the larger secondary throttle valve begins to rise together with the smaller primary throttle valve. A spring 35 is provided so as to press down the larger secondary throttle valve 32. When the throttle valve operating shaft 6 is anti-clockwise rotated by the returning motion of the accelerator pedal, the larger secondary throttle valve 32 is lowered together with the smaller primary throttle valve 31 by virtue of the spring 35. A ring 36 is provided at the upper part of the smaller throttle valve so that the smaller primary throttle valve 31 may entrain the larger secondary throttle valve 32 when it is lowered even if foreign matters such as sand particles are unexpectedly entrapped between the larger secondary throttle valve (piston) and the piston cylinder and the larger throttle valve cannot be lowered by means of the spring 35.

Figure 3:
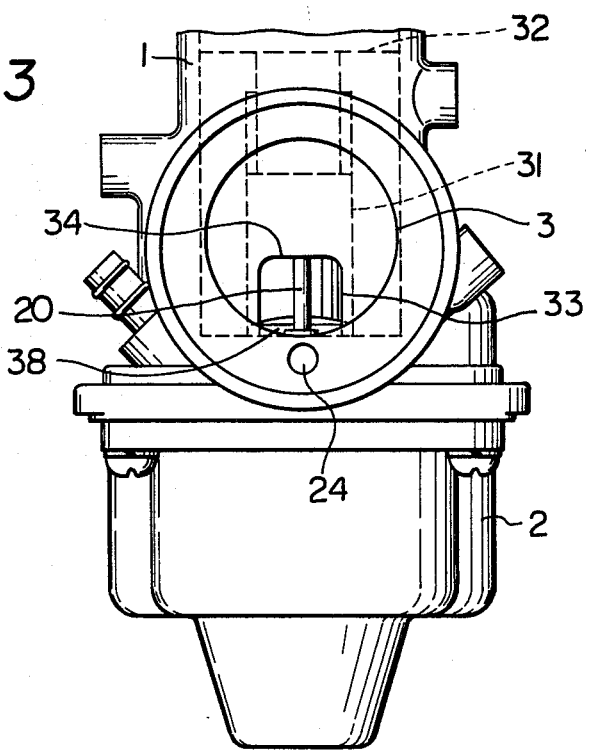
FIGS. 3, 4 and 5 are front views of the air inlet port of the double piston type throttle valve carburetor as shown in FIG. 2. showing the operation of the smaller primary piston thereof.
Figure 4:
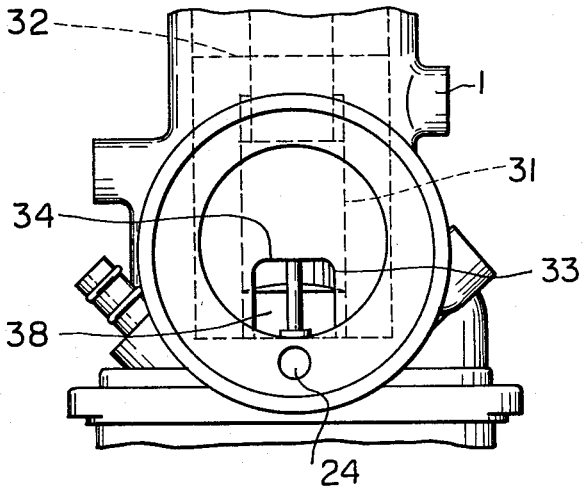
Figure 5:
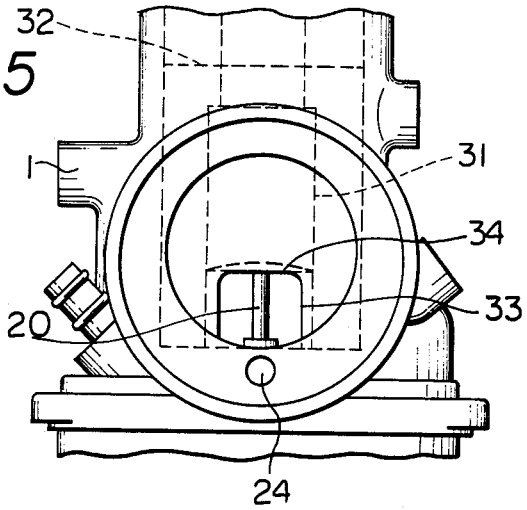
Figure 6:
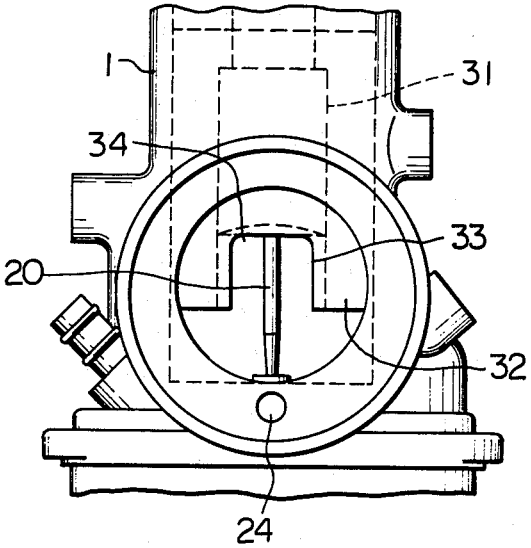
FIGS. 6 and 7 are front views of the air inlet port of the same carburetor showing operation of the larger secondary piston thereof.
Figure 7:
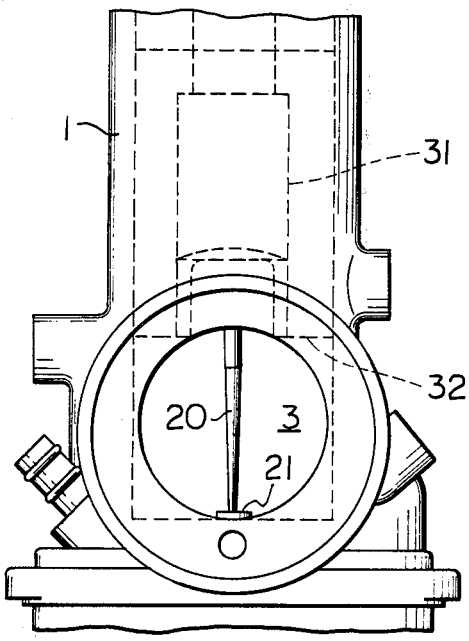

Operation of the double piston throttle valve of FIG. 2 is well illustrated in FIGS. 3–7, which are front views of the air inlet port of the carburetor. FIG. 3 shows the carburetor in idling. The smaller primary throttle valve 31 is slightly raised and air is supplied to the mixing chamber through the formed opening 38. FIG. 4 shows the stage at which the smaller primary throttle valve 31 is further raised. The opening 38 of the venturi 33 is now opened wider. The larger secondary throttle valve 32 is still closed. This corresponds to the light load operation of the engine. In FIG. 5, the smaller primary throttle valve is further raised, the bottom thereof is now on the same level as the ceiling surface 34 of the venturi 33 and the venturi 33 is completely opened. And the needle valve of the primary fuel feed system has been completely opened by this time. But the larger secondary throttle valve is still closed. This condition corresponds to the medium load operation of the engine. In FIG. 6, the larger secondary throttle valve 32 is now partly opened. And the needle valve of the secondary fuel feed system B is partly opened. In FIG. 7, the larger secondary throttle valve is now completely opened, and the needle valve of the secondary fuel feed system is also opened to the maximum. This condition corresponds to the full load operation.

As has been understood from the above description, the jet needle 10 of the primary fuel feed system is secured to the smaller primary throttle valve 31, and the jet needle 20 of the secondary fuel feed system is secured to the larger secondary throttle valve in front (the air inlet port side) of the smaller primary throttle valve, and the operation range of the primary fuel feed system corresponds to the operation range of the smaller primary throttle valve. On the other hand, the secondary fuel feed system B is operated after the larger secondary throttle valve begins to operate together with the smaller primary throttle valve.

However, in the throttle valve of FIG. 1, as it has only one piston throttle valve, the fuel feed by the secondary fuel feed system is deferred by employing for the secondary fuel feed system a jet needle the straight (cylindrical) part of which is longer than that of the primary fuel feed system. But in the throttle valve represented by FIG. 2, the larger secondary throttle valve 32 does not operate in the operation range of the smaller primary throttle valve, that is, in the light and medium load operation of the engine. Therefore, in this range, the needle jet 21, into which the jet needle 20 secured to the larger secondary throttle valve 32 is inserted, acts as a non-variable nozzle. At the same time, the negative air pressure applied to the opening of the secondary fuel feed system is weaker than the negative pressure applied to the opening of the primary fuel feed system at the light to medium load operation range, since the secondary fuel feed system is located on the upstream side of the carburetor where the air flow is not so fast as the position of the primary fuel feed system. Therefore, no spraying or introduction of the fuel occurs even if the clearance between the jet needle and needle jet of the secondary fuel feed system is considerably large. Thus regulation of fuel feed corresponding to air supply is automatically and more smoothly effected.

In this way the main jet of the fuel feed systems can be smaller and thus it is unnecessary to make the clearance between the jet needle and needle jet of the fuel feed systems extremely small.

At the transition stage when the larger secondary throttle valve begins to operate, the amount of air intake precipitously increases. The secondary fuel feed system well corresponds to this precipitous change and smoothly feeds additional supply of the fuel and prevents from resulting in poor acceleration, and thus smoothly accelerates the engine.

Although the invention has been explained in detail with respect to the embodiments in which two main fuel feed systems are employed, it will be understood that more than two fuel feed systems can be employed.

Having described our invention, we claim:

1. A piston type throttle valve carburetor which defines an air inlet port and is provided with a pilot fuel feed system, a double piston valve assembly which comprises a first piston type throttle valve and a second piston type throttle valve which is larger than the first piston type throttle valve, and first and second main fuel feed systems each comprising a main jet, a needle jet and a jet needle which is inserted in the needle jet, the jet needles of the first and second main fuel feed systems being secured to the first and second piston type throttle valves respectively, and the second main fuel feed system being located between the first main fuel feed system and the air inlet port and the carburetor also being provided with operating means connected to the double piston valve assembly for opening the first main fuel feed system before the second main fuel feed system is opened.

2. A carburetor as claimed in claim 1, wherein the first main fuel feed system is located at a position corresponding to the center of the first piston type throttle valve.

3. A carburetor as claimed in claim 2, wherein the needle valve of the first main fuel feed system operates corresponding to the operation of the first piston type throttle valve in the range from light load operation to medium load operation, and is completely opened when medium load operation is reached, the size of the main jet of the first main fuel feed system being such that it can supply fuel in an amount which supports medium load operation of the engine corresponding to the air intake at that stage, and wherein the needle valve of the second main fuel feed system operates corresponding to the operation of the second piston type throttle valve in the range from medium load operation to full load operation, and is completely opened when full load operation is reached, the size of the main jet of the second main fuel feed system being such that it can supply fuel in an amount which, in addition to the amount supplied by the first main fuel feed system, supports full load operation of the engine.

4. A carburetor as claimed in claim 1, wherein the second piston type throttle valve is fitted slidably within a cylinder defined by the carburetor and is provided with a spring which urges the second piston type throttle valve towards a closed position thereof, wherein the first piston type throttle valve extends slidably and coaxially within the second piston type throttle valve and the operating means is connected to the first piston type throttle valve for bringing about movement thereof along the common axis of the first and second piston type throttle valves between a closed position and an open position of the first piston type throttle valve, and wherein the first and second piston type throttle valves include respective abutment parts which permit movement of the first piston type throttle valve relative to the second piston type throttle valve when the latter is in a closed position from the closed position of the first piston type throttle valve to an intermediate position thereof, whereupon the abutment parts engage one another and further movement of the first piston type throttle valve away from its closed position is accompanied by movement of the second piston type throttle valve from its closed position towards its open position.

* * * * *